US007306304B2

(12) United States Patent
Jang

(10) Patent No.: US 7,306,304 B2
(45) Date of Patent: Dec. 11, 2007

(54) REFRIGERATOR SHELF

(75) Inventor: Dong Sik Jang, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 436 days.

(21) Appl. No.: 10/997,915

(22) Filed: Nov. 29, 2004

(65) Prior Publication Data

US 2005/0258725 A1 Nov. 24, 2005

(30) Foreign Application Priority Data

May 18, 2004 (KR) ..... 10-2004-0035321
May 18, 2004 (KR) ..... 10-2004-0035322

(51) Int. Cl.
*A47B 96/02* (2006.01)

(52) U.S. Cl. ..... 312/408

(58) Field of Classification Search ..... 312/401, 312/408, 410, 351; 108/27, 108; 211/153; D15/89; 40/718, 781
See application file for complete search history.

(56) References Cited

U.S. PATENT DOCUMENTS 2,186,643 A * 1/1940 Kaplan ..... 40/781
4,934,541 A * 6/1990 Bussan et al. ..... 211/153
5,125,175 A * 6/1992 Huff, Jr. ..... 40/718
5,205,059 A * 4/1993 Doll ..... 40/718
5,340,209 A * 8/1994 Kolbe et al. ..... 312/408
5,516,204 A * 5/1996 Calvert et al. ..... 312/408
5,947,574 A * 9/1999 Avendano ..... 312/408
6,422,673 B1 * 7/2002 Bienick ..... 312/408
6,811,045 B1 * 11/2004 Masker et al. ..... 211/153
2002/0149304 A1 * 10/2002 Bienick ..... 312/408

* cited by examiner

*Primary Examiner*—James O. Hansen
(74) *Attorney, Agent, or Firm*—Bacon & Thomas, PLLC

(57) ABSTRACT

A refrigerator shelf includes a glass sheet and upper and lower frames disposed at the edge of the glass sheet. The upper frame has latch parts formed at the lower surface thereof and the lower frame has flanges formed at the upper surface thereof so that the flanges are fitted to the latch parts at both sides of the upper and lower frames. The upper frame is further provided with holes and protrusions formed at the front and rear ends thereof, respectively, and the lower frame is further provided with protrusions and holes formed at the front and rear ends of the lower frame, respectively, so that the holes and protrusions of the upper frame are correspondingly engaged with the protrusions and holes of the lower frame at the front and rear ends of the upper and lower frames.

11 Claims, 14 Drawing Sheets

REFRIGERATOR SHELF

FIELD OF THE INVENTION

The present invention relates to a refrigerator shelf, and, more particularly, to an improved refrigerator shelf having a glass sheet, which is used as a supporting panel, and frames disposed at the edge of the glass sheet wherein the frames are easily assembled with the glass sheet without welding.

BACKGROUND OF THE INVENTION

Generally, at least one refrigerator shelf 2, on which goods to be kept cold are placed, is mounted to the liner of a refrigerator, so as to efficiently utilize the inner space of a chilling chamber 1 of the refrigerator. The refrigerator shelf 2 is disposed on beads 5 formed at the side surfaces of the liner of the refrigerator such that the refrigerator shelf 2 is supported by means of the beads 5 of the liner of the refrigerator as shown in FIGS. 1A, or the refrigerator shelf 2 is mounted to the refrigerator by means of brackets 4 attached to the refrigerator shelf 2 as shown in FIG. 1B. The brackets 4 are supported by means of support members 3 disposed at the rear surfaces of the liner of the refrigerator.

The refrigerator shelf 2 is generally manufactured by molding a plastic material. Alternatively, wires may be formed in the shape of a net so as to manufacture the refrigerator shelf 2. However, the refrigerator shelf made of the plastic material has a problem in that it may be deformed depending on how it is used, and the refrigerator shelf made of the wires has a problem in that small goods to be kept cold may drop through the net, and, when watery goods are spilled, other goods to be kept cold, which are placed below the refrigerator shelf, may get dirty. For these reasons, there has been recently used a glass shelf comprising a glass sheet, used as a supporting plate, and a plastic frame integrally attached to the edge of the glass sheet, which is used for high-grade refrigerators.

U.S. Pat. No. 4,934,541 discloses a method of manufacturing a refrigerator shelf comprising: disposing a glass sheet on a lower frame; attaching an upper frame to the lower frame by ultrasonic welding while the upper and lower frames are disposed at edge of the glass sheet; and filling a sealing material between the upper frame and the glass sheet.

In the refrigerator shelf disclosed in the '541 patent, however, the upper and lower frames, which are manufactured by molding plastic materials, are integrated by ultrasonic welding. Consequently, an ultrasonic welding facility is required, and the assembling process of the refrigerator shelf is complicated.

U.S. Pat. No. 5,362,145 discloses a glass shelf for refrigerators wherein the edge part of a glass sheet is formed by injection molding of a plastic material. In the '145 patent, brackets are integrally formed with the edge part of the glass sheet by injection molding of the plastic material when the edge part of the glass sheet is formed, if necessary.

In the glass shelf for refrigerators disclosed in '145 patent, however, the glass sheet is placed in a mold, and then the edge part of the glass sheet is formed by injection molding of the plastic material. Consequently, a high-priced injection-molding machine is required, and a high-precision control is also required, which increases the manufacturing costs of glass shelf for refrigerators. Also, the brackets are integrally formed with the edge part of the glass sheet by injection molding of the plastic material. Consequently, it is necessary that various shelves be individually manufactured depending on how or where the shelves are used.

SUMMARY OF THE INVENTION

Therefore, the present invention has been made in view of the above problems, and it is a primary object of the present invention to provide a refrigerator shelf comprising a glass sheet, which is used as a supporting panel, and frames disposed at the edge of the glass sheet wherein the frames are easily assembled with the glass sheet.

It is another object of the present invention to provide a refrigerator shelf that may be directly disposed at the liner of a refrigerator, or that may be disposed through the use of brackets being supported by means of support members disposed at the liner of the refrigerator.

In accordance with a first embodiment of the present invention, the above and other objects can be accomplished by the provision of a shelf for a refrigerator having a bead, which comprises: a glass sheet; upper and lower frames disposed at the edge of the glass sheet; first engaging means disposed at both sides of the upper and lower frames such that the glass sheet is fixedly disposed between the lower surface of the upper frame and the upper surface of the lower frame; second engaging means disposed at the front and rear ends of the upper and lower frames; and sealing means disposed between the lower surface of the upper frame and the glass sheet for preventing liquid from leaking into the space between the lower surface of the upper frame and the glass sheet.

In accordance with a second embodiment of the present invention, the above and other objects can be accomplished by the provision of a shelf for a shelf for a refrigerator having support members, which comprises: a glass sheet; upper and lower frames disposed at the edge of the glass sheet; first engaging means disposed at both sides of the upper and lower frames such that the glass sheet is fixedly disposed between the lower surface of the upper frame and the upper surface of the lower frame; second engaging means disposed at the front and rear ends of the upper and lower frames; sealing means disposed between the lower surface of the upper frame and the glass sheet for preventing liquid from leaking into the space between the lower surface of the upper frame and the glass sheet; and brackets attached to both sides of the shelf and having latch protrusions at the rear ends of the brackets, the latch protrusions being engaged with the support members.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1A:
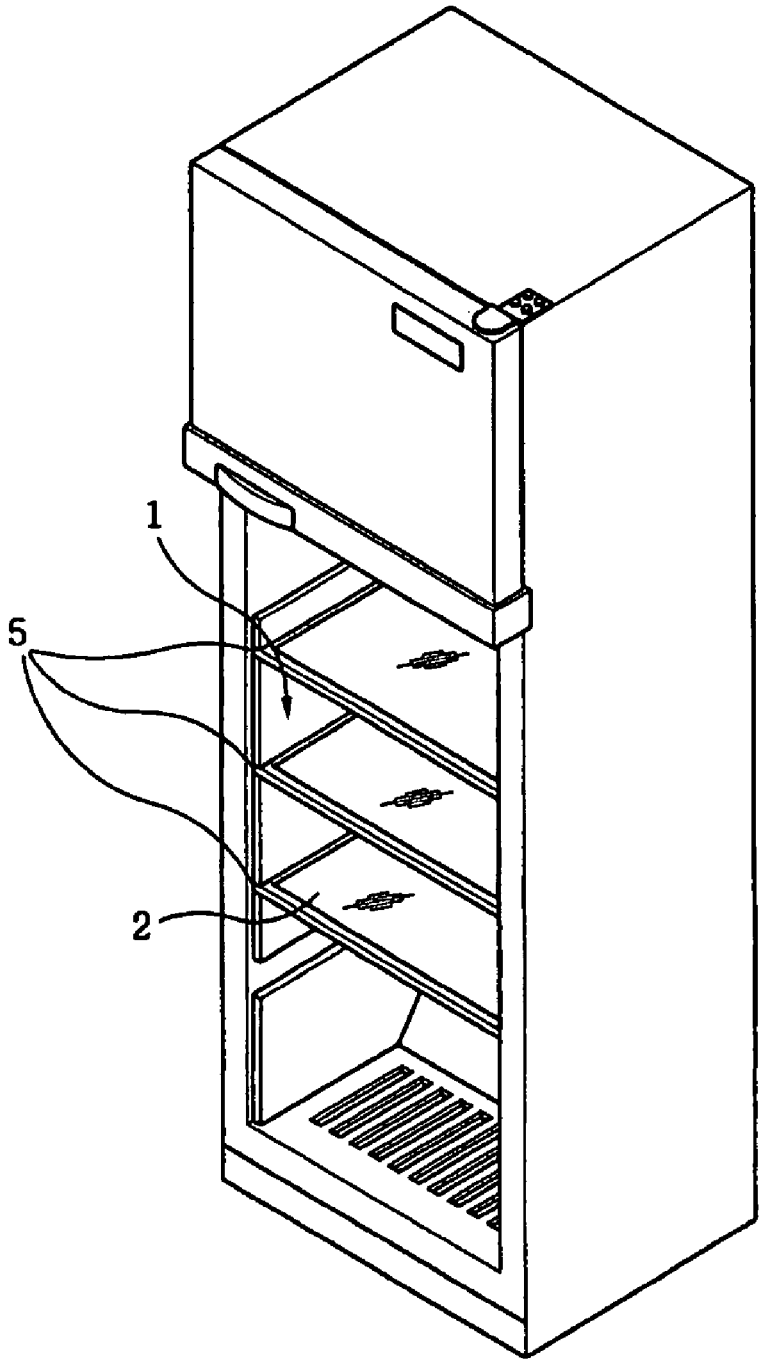
FIG. 1A (PRIOR ART)
FIG. 1A is a perspective view schematically showing a conventional refrigerator shelf supported by means of beads formed on the liner of a refrigerator.

Preferred embodiments of the present invention will be described in detail with reference to the accompanying drawings. In the drawings, the same or similar elements are denoted by the same reference numerals even though they are depicted in different drawings.

Figure 2:
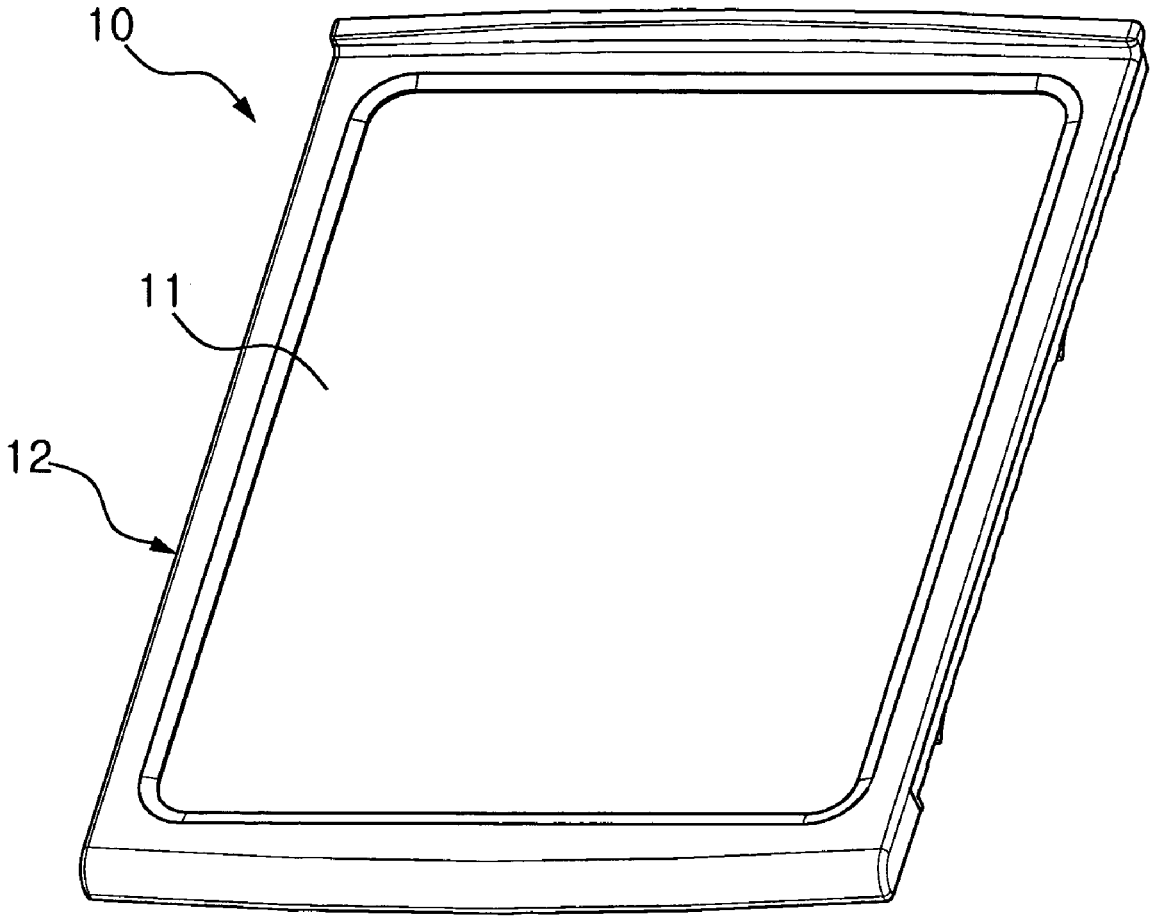
FIG. 2 is a perspective view showing a refrigerator shelf according to a first preferred embodiment of the present invention.

Referring to FIGS. 2 to 8, there is illustrated a refrigerator shelf 10 according to a first preferred embodiment of the present invention. The refrigerator shelf 10 according to a first preferred embodiment of the present invention comprises: a glass sheet 11, which is used as a supporting panel at the middle of the refrigerator shelf 10; and a frame assembly 12 attached to the edge of the glass sheet 11 while seal is accomplished between the glass sheet 11 and the frame assembly 12, as shown in FIG. 2.

Figure 3:
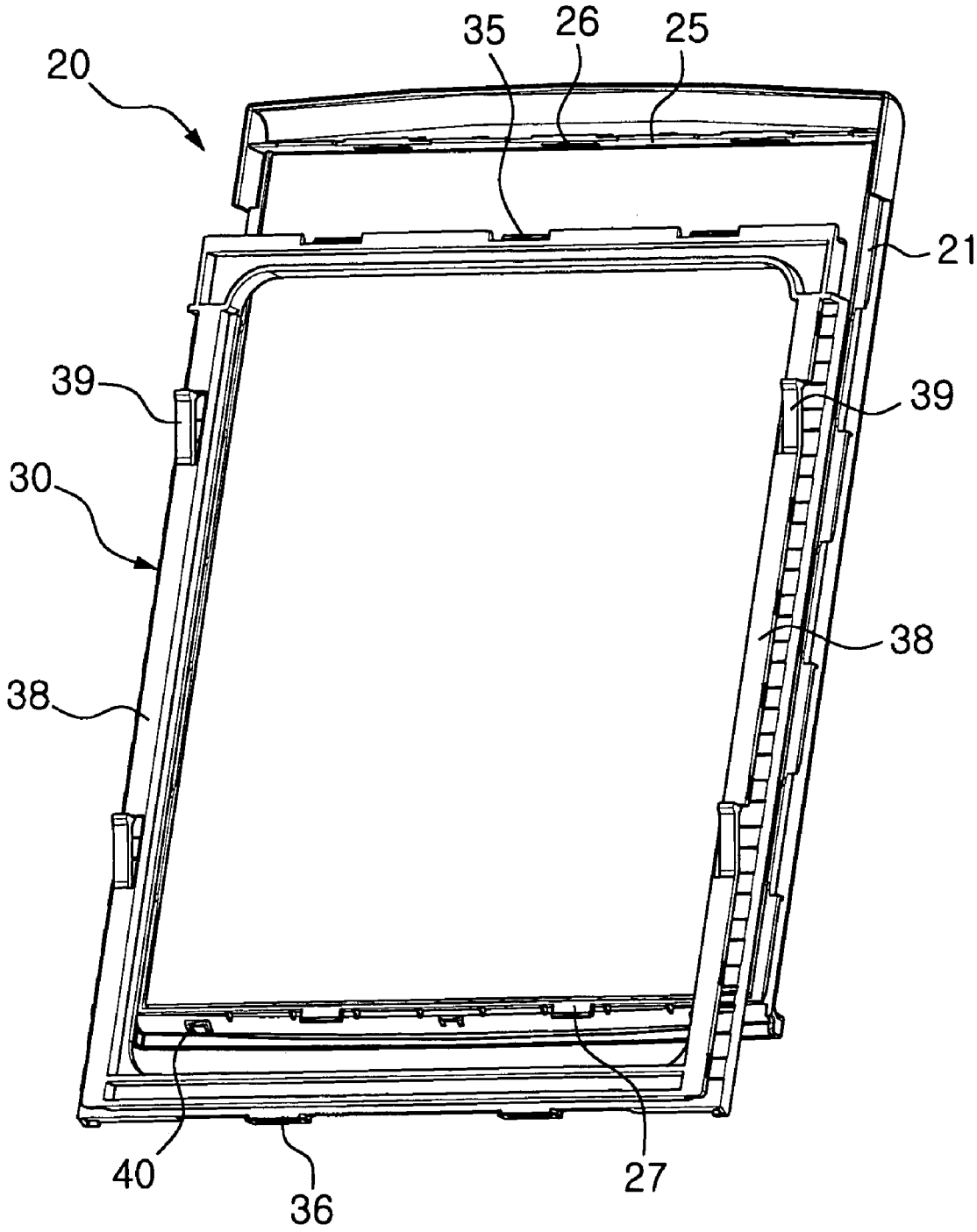
FIG. 3 is an exploded perspective view of the refrigerator shelf shown in FIG. 2 as seen from below.
Figure 4:
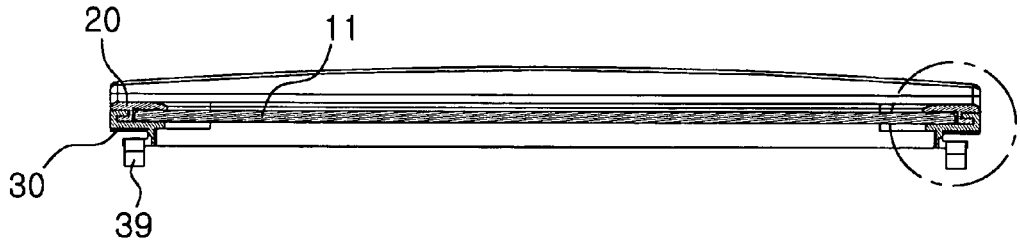
FIG. 4 is a cross-sectional view of the refrigerator shelf shown in FIG. 2.
Figure 5:
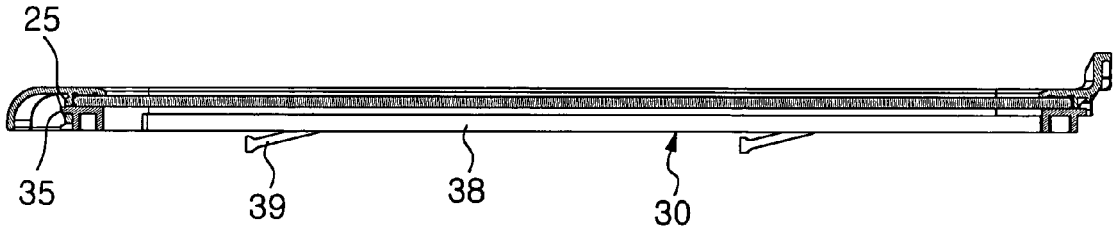
FIG. 5 is a longitudinal-sectional view of the refrigerator shelf shown in FIG. 2.

Referring to FIG. 3, the frame assembly 12 of the refrigerator shelf 10 includes an upper frame 20 and a lower frame 30 which are made of plastic materials. The glass sheet 11 is disposed between the upper frame 20 and the lower frame 30. Formed at the lower surface of the upper frame 20 is a plurality of grooves 21, which are disposed along the circumference of the upper frame 20.

Figure 6:
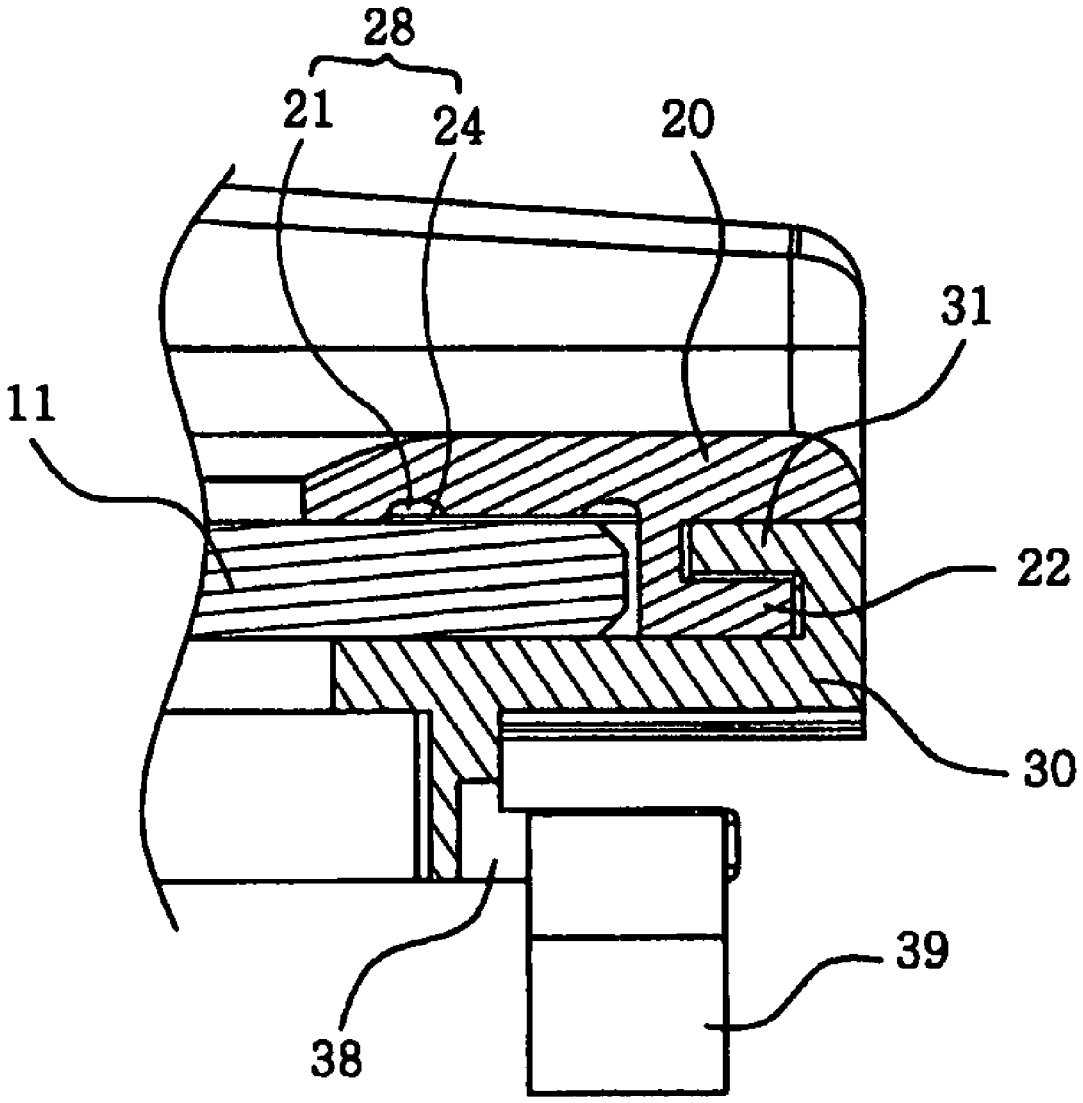
FIG. 6 is an enlarged sectional view showing the circled part of FIG. 4.

As shown in FIG. 6, the front and rear ends of the upper frame 20 are engaged with the front and rear ends of the lower frame 30 when the refrigerator shelf 10 is assembled. Similarly, both sides of the upper frame 20 are engaged with both sides of the lower frame 30 when the refrigerator shelf 10 is assembled. At both sides of the lower surface of the upper frame 20 are formed a plurality of latch parts 22, which are spaced apart from each other. The latch parts 22 extend downward and are then bent outward. Sealing means 28 is disposed between the lower surface of the upper frame 20 and the glass sheet 11. The sealing means 28 includes the grooves 21 and silicon rubber 24. Silicon rubber 24 is filled in the grooves 21 so as to prevent liquid from leaking into the space between the upper surface of the glass sheet 11 and the upper frame 20 when the refrigerator shelf 10 is assembled.

At both sides of the upper surface of the lower frame 30, which is opposite to the upper frame 20, are formed a plurality of flanges 31, which extend upward and are then bent inward. Consequently, when the lower frame 30 is engaged with the upper frame 20, the flanges 31 of the lower frame 30 are engaged with the latch parts 22 of the upper frame 20. The flanges 31 of the lower frame 30 along with the latch parts 22 of the upper frame 20 serve as first engaging means, by which the upper frame 20 is engaged with the lower frame 30. The reason why the latch parts 22 of the upper frame 20 are spaced apart from each other is that the friction between the flanges 31 and the latch parts 22 is reduced when the lower frame 30 is engaged with the upper frame 20, and thus the assembly of the lower frame 30 and the upper frame 20 is easily performed.

Figure 7:
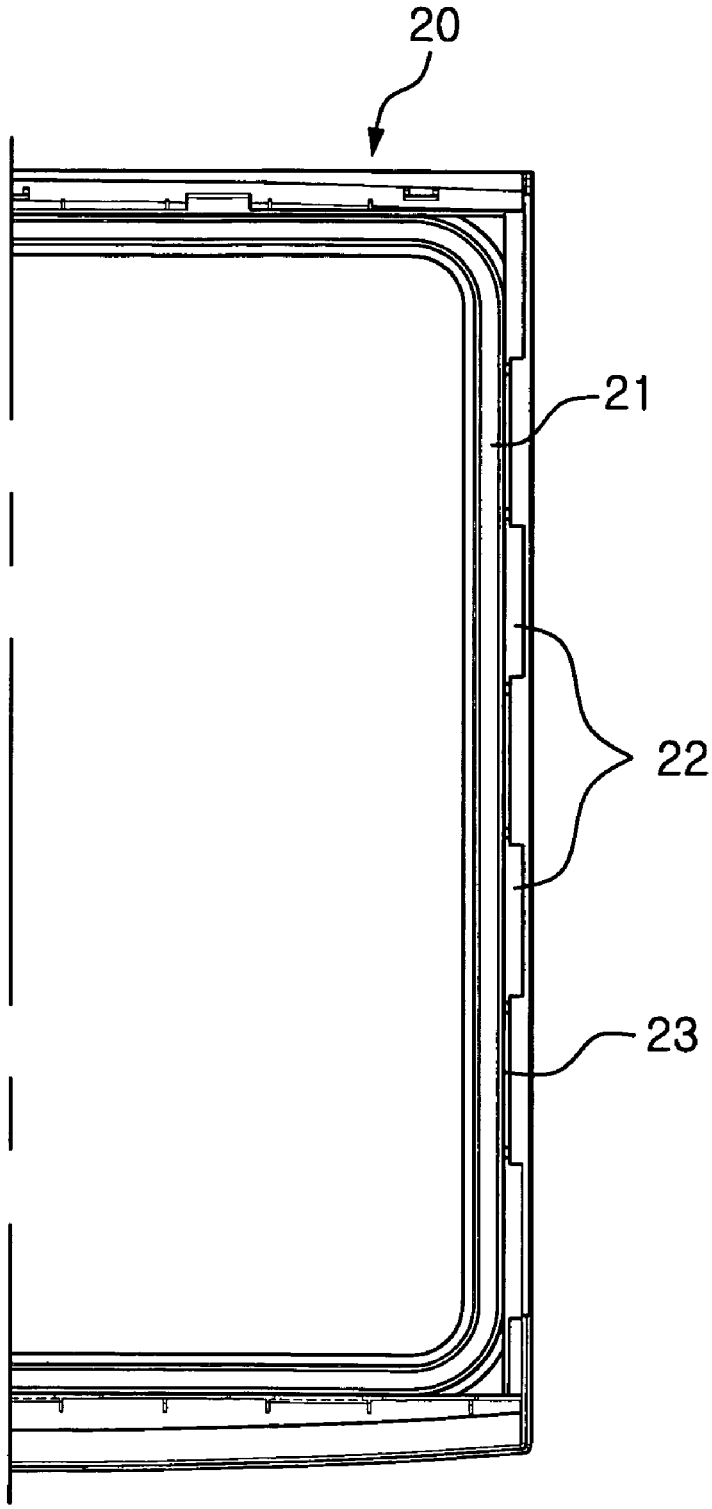
FIG. 7 is a bottom view, in part, showing an upper frame of the refrigerator shelf, according to a first preferred embodiment of the present invention.
Figure 8:
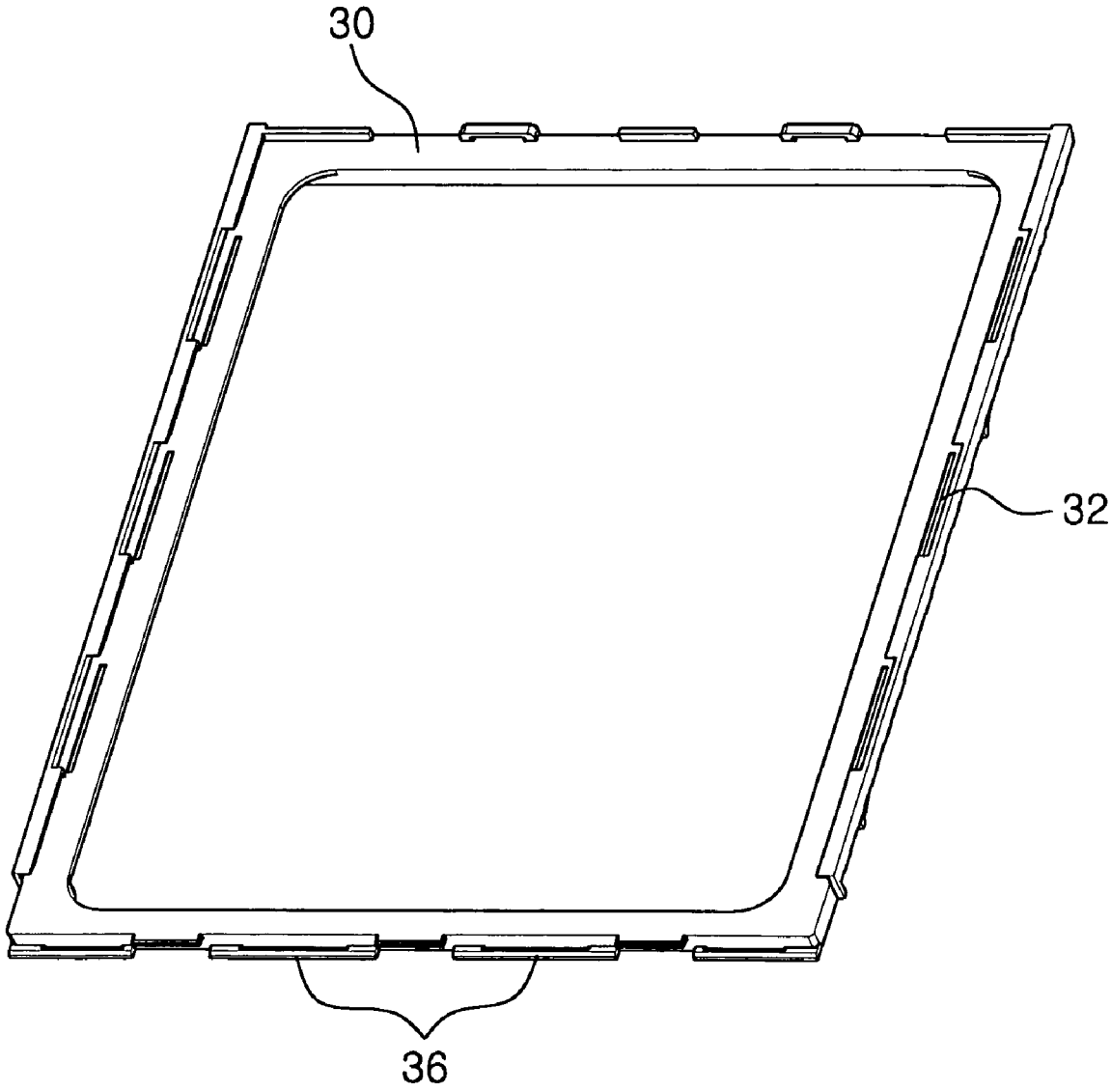
FIG. 8 is a perspective view showing a lower frame of the refrigerator shelf, according to a first preferred embodiment of the present invention, as seen from above.
Figure 9:
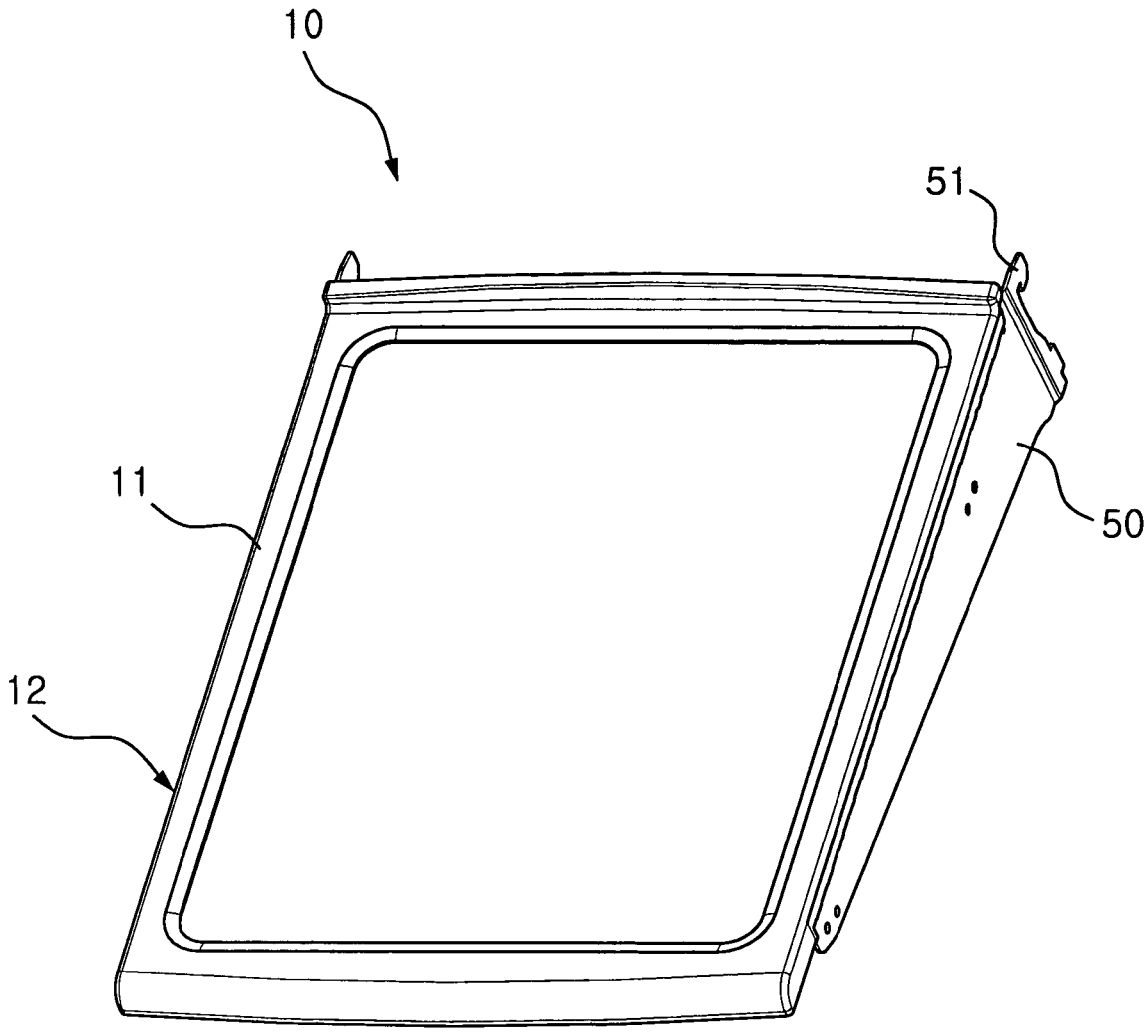
FIG. 9 is a perspective view showing a refrigerator shelf with brackets attached thereto, according to a second preferred embodiment of the present invention.
Figure 10:
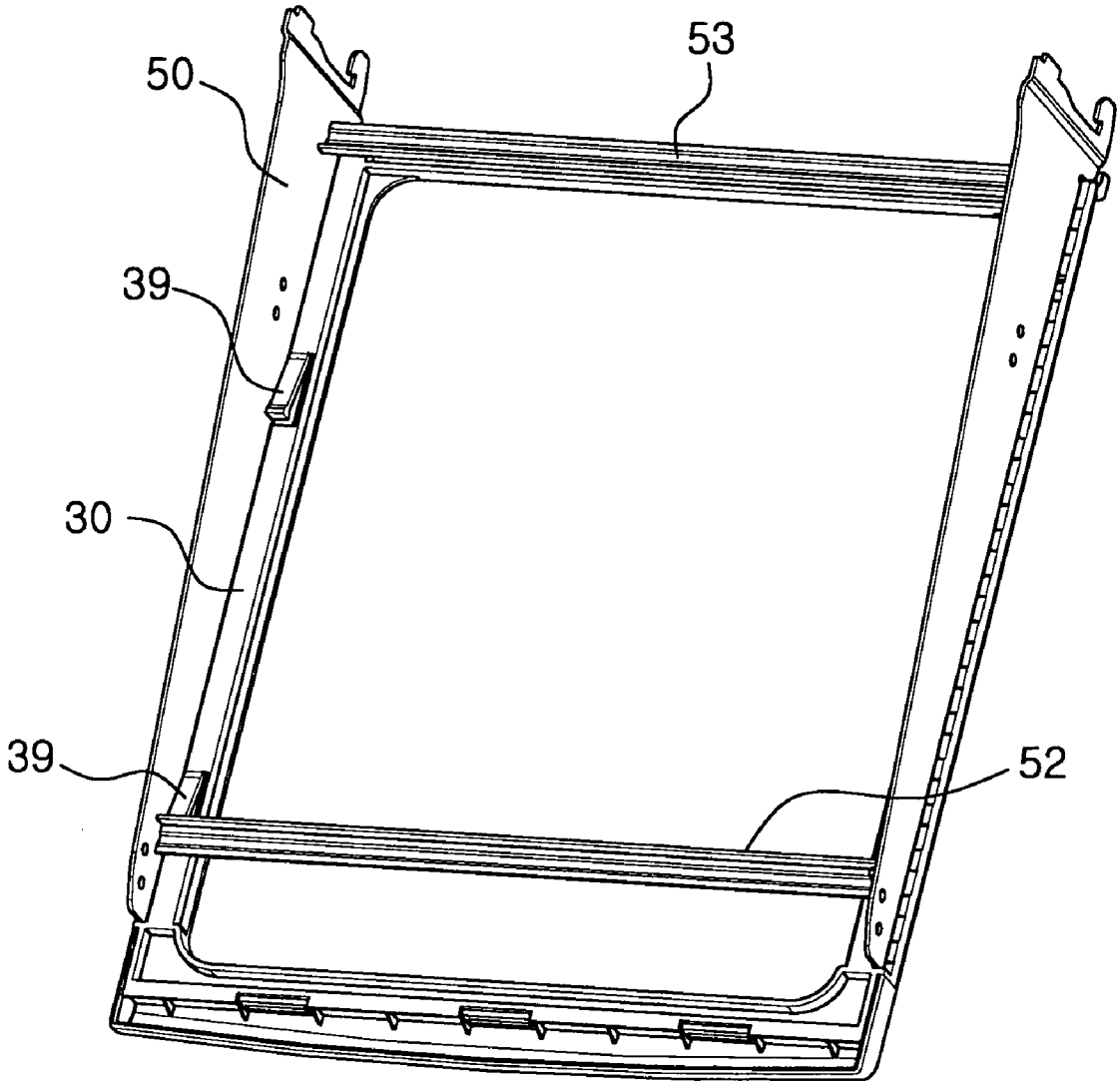
FIG. 10 is a perspective view of the refrigerator shelf shown in FIG. 9 as seen from below.

At both sides of the lower surface of the upper frame 20 are formed protrusions 23, in the longitudinal direction of the upper frame 20, as shown in FIG. 7. Correspondingly, slits 32 are formed at both sides of the upper surface of the lower frame 30, as shown in FIG. 8. When the refrigerator shelf 10 is assembled, the protrusions 23 are fitted in the slits 32, respectively, such that the lower frame 30 is fixedly engaged with the upper frame 20.

At the front end of the upper frame 20 is formed a rib 25, which extends downward from the lower surface of the upper frame 20 (shown to extend upward in FIG. 3). At the rib 25 are formed a plurality of holes 26 (for example, 3 in number). Correspondingly, a plurality of protrusions 35, the numbers of which corresponds to those of holes 26 of the rib, are formed at the front end of the lower frame 30. When the upper frame 20 is engaged with the lower frame 30, the protrusions 35 of the lower frame 30 are fitted in the holes 26 of the upper frame 20, respectively.

At the rear end of the upper frame 20 are formed a plurality of protrusions 27 (for example, 2 in number). Correspondingly, holes 36 are formed at a rib disposed at the rear end of the lower frame 30. When the upper frame 20 is engaged with the lower frame 30, the protrusions 27 of the lower frame 30 are fitted in the holes 36 of the upper frame 20, respectively.

The protrusions 35 of the lower frame 30 and the holes 26 of the upper frame 20 together form second engaging means to securely engage the upper frame 20 with the lower frame 30.

At the rear end of the lower surface of the upper frame 20 are formed snap protrusions 40 as shown in FIG. 3, which extend downward from the lower surface of the upper frame 20. When the lower frame 30 is engaged with the upper frame 20, the snap protrusions 40 of the upper frame 20 are engaged with the rear end of the lower frame 30. As a result, the upper frame 30 is prevented from being moved to the rear of the upper frame 20.

At both sides of the lower surface of the lower frame 30 are formed ribs 38, which extend downward (shown to extend upward in FIG. 3) and are then bent outward. Each of the ribs 38 has at least two stoppers 39, which are formed by cutting each of the ribs 38 at predetermined positions and then bending each of the ribs 38 by predetermined lengths such that the cut ends of each of the ribs 38 are protruded from the other parts of each of the ribs 38. When the refrigerator shelf 10 is mounted to the liner of the refrigerator, the stoppers 39 of the refrigerator shelf 10 are latched by means of the ends of the beads 5 of the liner of the refrigerator. Consequently, the refrigerator shelf 10 is prevented from being slid to the front of the refrigerator, and thus the refrigerator shelf 10 is safely disposed at the liner of the refrigerator.

The assembling process of the upper frame 20 and the lower frame 30 of the refrigerator shelf with the above-described engaging structure will now be described in brief.

First, the silicon rubber 24 is filled in the grooves 21 disposed along the circumference of the upper frame 20 while the upper frame 20 is turned upside down as shown in FIG. 3. Next, the glass sheet 11 is disposed on the upper frame 20, and the lower frame 30 is disposed on the upper frame 20 such that the flanges 31 formed at the upper surface of the lower frame 30 is fitted into the spaces defined between the latch parts 22 of the upper frame 20 and the lower surface of the upper frame 20. After that, the lower frame 30 is pushed from the rear of the upper frame 20 to the front of the upper frame 20 such that the protrusions 23 formed at the lower surface of the upper frame 20 are fitted into the corresponding slits 32 of the lower frame 30, the protrusions 35 formed at the front end of the lower frame 30 are fitted into the holes 26 of the rib 25 formed at the front end of the upper frame 20, and the protrusions 27 formed at the rear end of the upper frame 20 are fitted into the holes 36 formed at the rear end of the lower frame 30. Consequently, the refrigerator shelf 10 is assembled while the glass sheet 11 is stably fixed between the upper frame 20 and the lower frame 30. At this time, the lower frame 30 is not moved to the rear of the upper frame 20 by means of the snap protrusions 40 extending downward from the rear end of the lower surface of the upper frame 20.

In this way, the glass sheet 11 is securely disposed between the assembled upper and lower frames. The silicon rubber 24, which has been filled in the grooves 21 formed along the circumference of the lower surface of the upper frame 20, is attached to the upper surface of the glass sheet 11, and is then solidified. Consequently, when any liquid is spilled on the upper surface of the glass sheet 11, it is not prevented from leaking into the space between the glass sheet 11 and the upper frame 20.

Referring to FIGS. 9 to 15, there is illustrated a refrigerator shelf according to a second preferred embodiment of the present invention.

The refrigerator shelf according to the second preferred embodiment of the present invention is identical in structure to the refrigerator shelf according to the first preferred embodiment of the present invention except that the refrigerator shelf having brackets attached thereto, the brackets being supported by means of support members disposed at the liner of the refrigerator. Thus, a description of the like parts in the first and the second embodiments will be omitted for the simplicity of explanation, and instead the distinctive configuration of the bracket will be focused and elaborated.

Figure 1B:
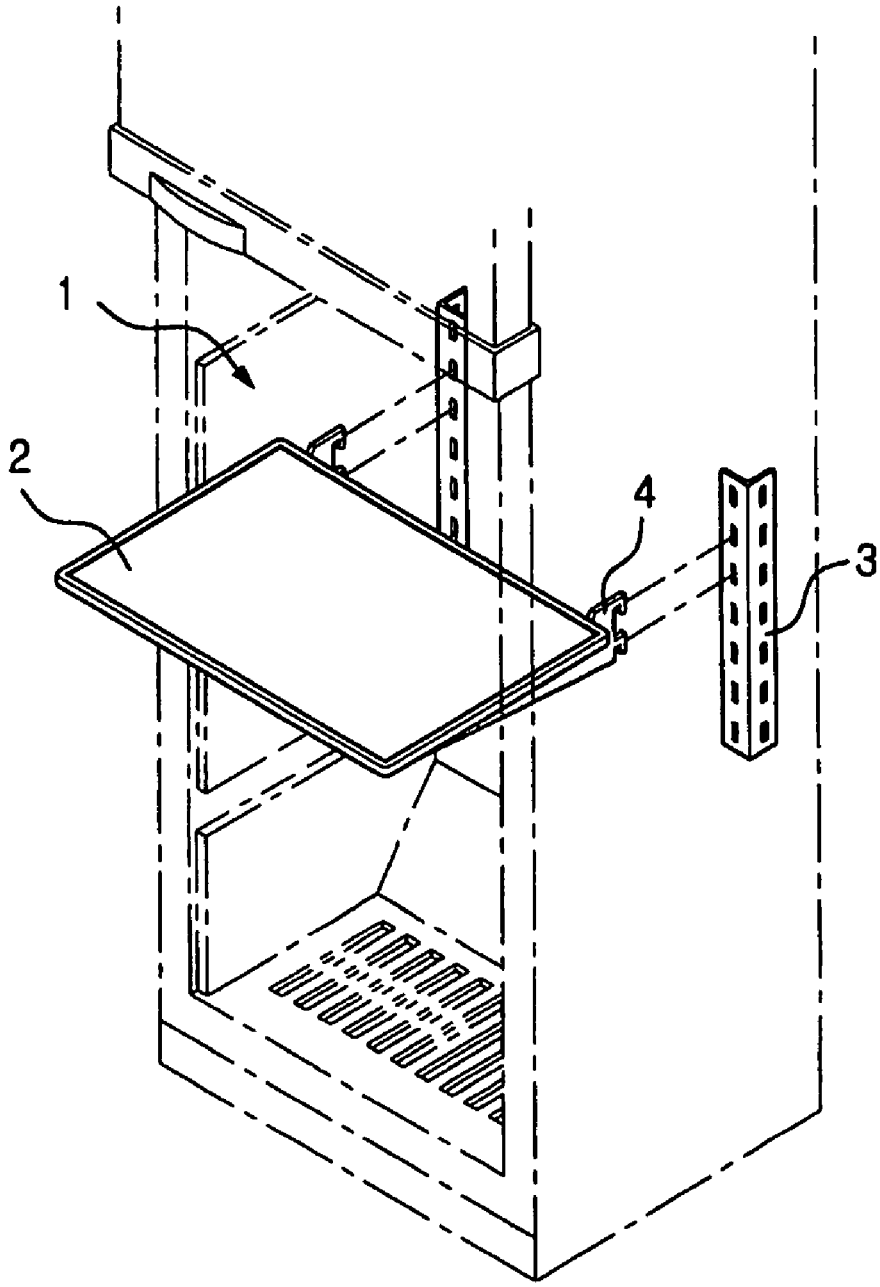
FIG. 1B (PRIOR ART)
FIG. 1B is a perspective view schematically showing another conventional refrigerator shelf with brackets attached thereto, the brackets being supported by means of support members attached to the liner of a refrigerator.
Figure 13:
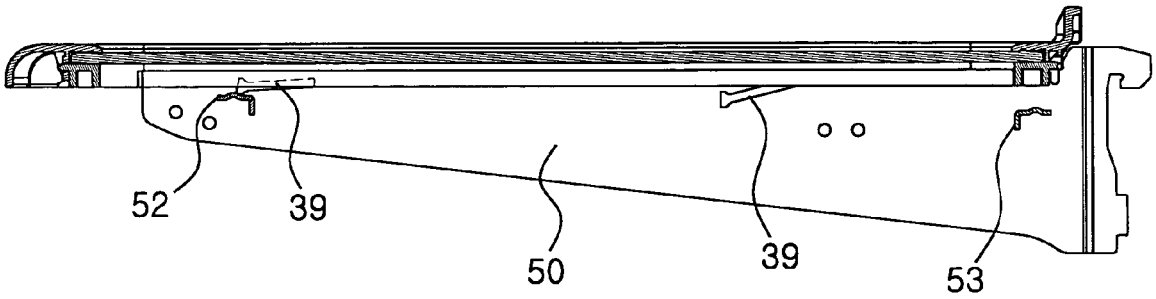
FIG. 13 is a longitudinal-sectional view schematically showing that the refrigerator shelf is pulled to the front of the brackets, according to a second preferred embodiment of the present invention.
Figure 14:
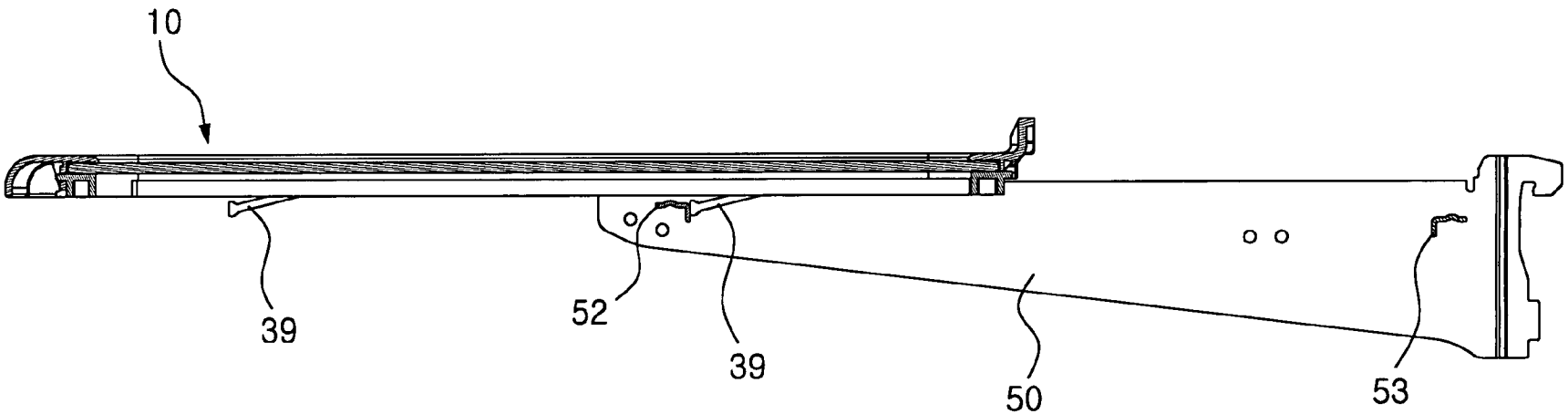
FIG. 14 is a longitudinal-sectional view showing the refrigerator shelf moved forward from the brackets shown in FIG. 13.
Figure 15:
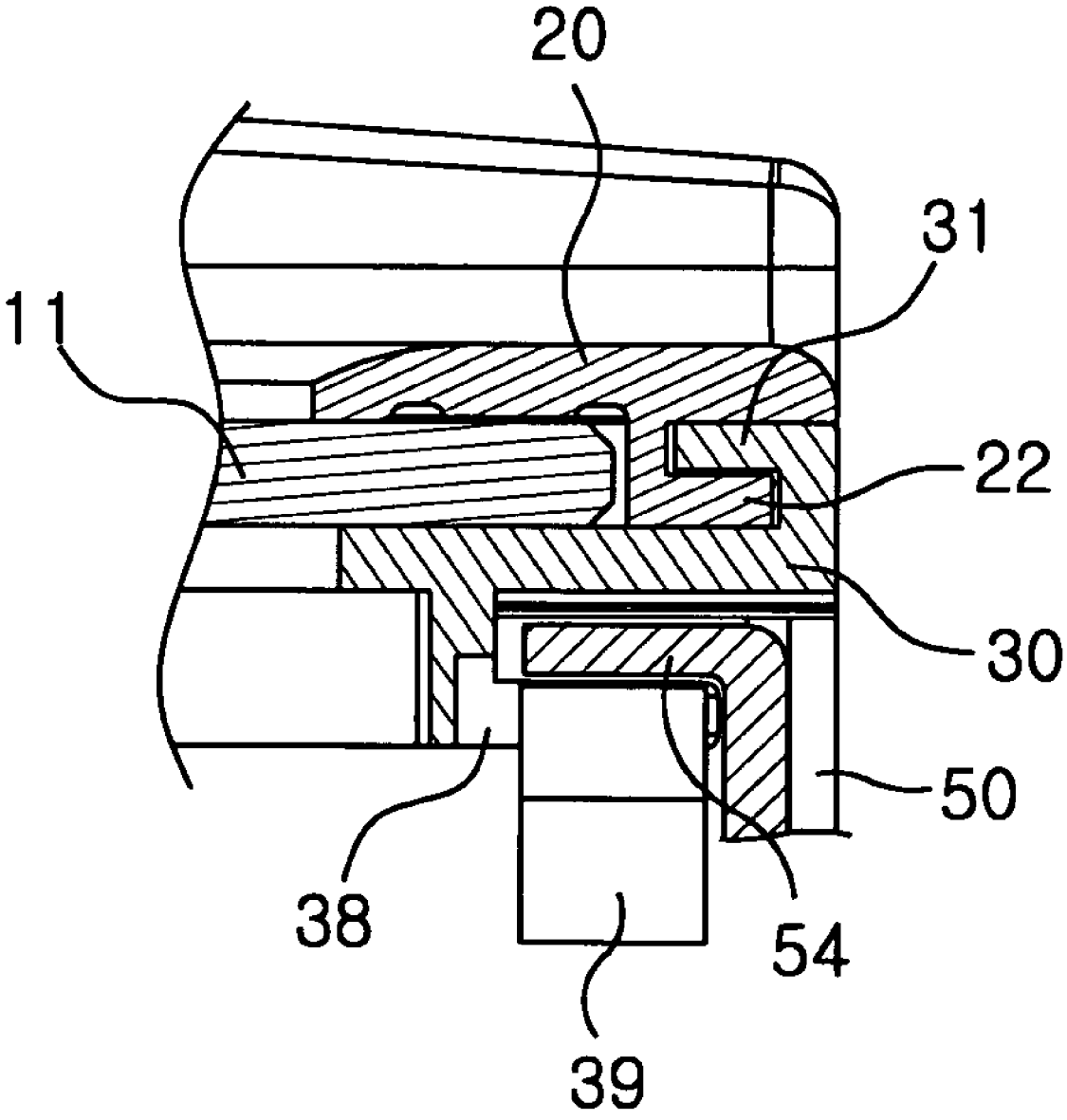
FIG. 15 is a partial side view, in section, of the refrigerator shelf of FIG. 4, showing the connection between the refrigerator shelf and the brackets.

To both sides of the refrigerator shelf 10 are attached brackets 50, as shown in FIGS. 9 to 15. At the rear ends of the brackets 50 are formed latch protrusions 51, which are engaged with the support members 3 (see FIG. 1B). The brackets 50 have connection members 52 and 53 integrally formed therewith and extending therebetween. The connection members 52 and 53 are horizontally disposed between both sides of the brackets 50 and at the front and rear parts of the brackets 50, respectively, such that the brackets 50 are spaced a predetermined distance from each other. Each of front and rear connection members 52 and 53 has a first surface and a second surface perpendicular to the first surface. The first surface serves to slide the stoppers 39 by pressing the inclined rear surfaces of the stoppers 39, while the second surface serves to block the stopper 39 by contacting with the inclined rear surfaces of the stoppers 39. Moreover, at the upper ends of the brackets 50 are formed flanges 54, which are formed along the longitudinal direction of the refrigerator shelf 10 and are bent inward as shown in FIG. 15. When the brackets 50 are coupled to the refrigerator shelf 10 in such a way of putting the bracket 50 upon the refrigerator shelf 10 or vice versa, the flanges 54 of the brackets 50 are fitted in the gaps defined between the lower surface of the lower frame 30 and the ribs 38 of the lower frame 30.

Figure 11:
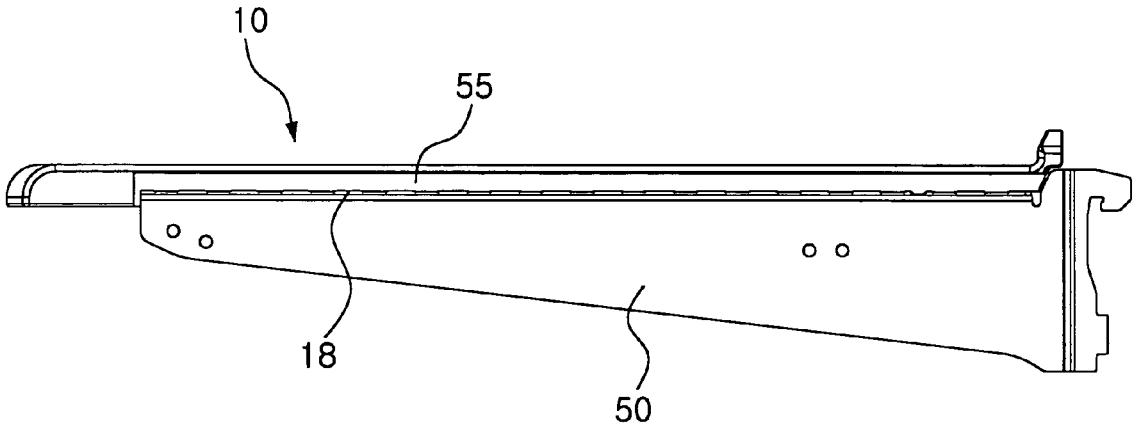
FIG. 11 is a side view of the refrigerator shelf shown in FIG. 9.

On the other hand, at the lower surface of the lower frame 30 are formed grooves 55, which are spaced a predetermined distance from each other, as shown in FIG. 11. Consequently, the friction is reduced when the brackets 50 are coupled to the refrigerator shelf 10 while the refrigerator shelf 10 is in partial contact with the flanges 54 of the brackets 50.

Figure 12:
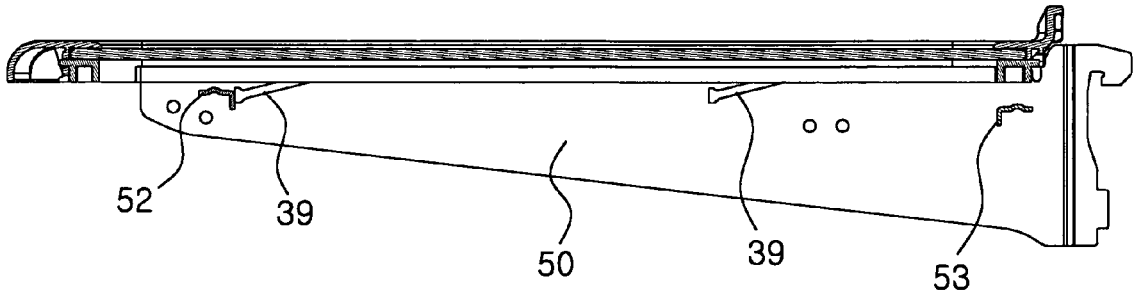
FIG. 12 is a longitudinal-sectional view schematically showing that the refrigerator shelf is immovably and fixedly by the brackets, according to a second preferred embodiment of the present invention.

Referring to FIG. 12, there is illustrated the case that the refrigerator shelf 10 is immovably and fixedly arranged by the brackets 50. As shown in FIG. 12, the front stoppers 39 are in contact with the second surface of the front connection member 52 of the brackets 50. Consequently, the refrigerator shelf 10 is prevented from being moved forward (to the left in the drawing).

Alternatively, referring to FIGS. 13 to 15, there is illustrated a case where the refrigerator shelf 10 can be pulled to the front of the brackets 50. In this case, the position of the front connection member 52 is moved more rearward than that of the front connection member 52 of the immovable refrigerator shelf 10, as shown in FIG. 13. As a result, the front connection member 52 is disposed above the stoppers 39 such that the stoppers 39 are depressed by means of the first surface of the front connection member 52. Consequently, the stoppers 39 cannot serve to stop the refrigerator shelf 10.

A user may pull the refrigerator shelf 10 forward, as shown in FIG. 14, so as to easily take goods from the refrigerator shelf 10. As the refrigerator shelf 10 is pulled forward, the rear stoppers 39 are caught by the second surface of the front connection member 52. As a result, the refrigerator shelf 10 is prevented from being further pulled forward, and thus the refrigerator shelf 10 is prevented from being separated from the brackets 50.

When the user pulls the refrigerator shelf 10 to take goods from the refrigerator shelf 10 or put goods on the refrigerator shelf 10, and then pushes the refrigerator shelf 10, the first surface of the front connection member 52 of the brackets 50 comes into contact with the inclined rear surfaces of the front stoppers 39. As a result, the stoppers 39 is resiliently pressed by means of the first surface of the front connection member 52, and thus the refrigerator shelf 13 is returned to its original position where the refrigerator shelf 13 is normally disposed in the liner of the refrigerator, as shown in FIG. 13.

By virtue of the grooves 55 formed at the lower surface of the lower frame 30 are formed, the friction is reduced when the refrigerator shelf 10 is pulled or pushed while the refrigerator shelf 10 is in partial contact with the flanges 54 of the brackets 50, and thus the refrigerator shelf 10 can be smoothly slid from the flanges 54 of the brackets 50.

As can easily understood from the above description, the refrigerator shelf according to the second preferred embodiment of the present invention may be used as the immovable refrigerator shelf, which is fixedly connected to the brackets, or the slidable refrigerator shelf, which is slidably connected to the brackets, through the change of the position of the front connection member.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A shelf for a refrigerator having beads comprising:

a glass sheet;

upper and lower frames disposed at the edge of the glass sheet;

first engaging means disposed at both sides of the upper and lower frames such that the glass sheet is fixedly disposed between the lower surface of the upper frame and the upper surface of the lower frame;

second engaging means disposed at the front and rear ends of the upper and lower frames; and sealing means disposed between the lower surface of the upper frame and the glass sheet for preventing liquid from leaking into the space between the lower surface of the upper frame and the glass sheet, wherein the first engaging means includes:

latch parts formed at both sides of the lower surface of the upper frame, the latch parts extending downward and being bent outward; and flanges formed at both sides of the upper surface of the lower frame, the flanges extending upward and being then bent inward such that the flanges of the lower frame are engaged with the latch parts of the upper frame.

2. The shelf as set forth in claim 1, wherein the second engaging means includes:

at least one first hole formed at the front end of the upper frame;

at least one first protrusion formed at the front end of the lower frame such that the first protrusion is fitted in the first hole;

at least one second protrusion formed at the rear end of the upper frame; and at least one second hole formed at the rear end of the lower frame such that the second protrusion is fitted in the second hole.

3. The shelf as set forth in claim 1, wherein the sealing means includes: a plurality of grooves formed along the circumference of the upper frame; and silicon rubber filled in the grooves.

4. The shelf as set forth in claim 1, wherein the lower frame is provided with ribs at both sides of the lower surface thereof, each of the ribs having at least one stopper formed by cutting the rib and then bending downward; and wherein the stoppers are caught by the ends of the beads such that the shelf is not moved to the front of the refrigerator.

5. A shelf for a refrigerator having support members comprising:

a glass sheet;

upper and lower frames disposed at the edge of the glass sheet;

first engaging means disposed at both sides of the upper and lower frames such that the glass sheet is fixedly disposed between the lower surface of the upper frame and the upper surface of the lower frame;

second engaging means disposed at the front and rear ends of the upper and lower frames;

sealing means disposed between the lower surface of the upper frame and the glass sheet for preventing liquid from leaking into the space between the lower surface of the upper frame and the glass sheet; and brackets attached to both sides of the shelf and having latch protrusions at the rear ends of the brackets, the latch protrusions being configured to be engaged with the support members, wherein the lower frame is provided with ribs at both sides of the lower surface thereof, the ribs extending downward and being then bent outward; and wherein the brackets have flanges formed and being bent inward at the upper ends thereof, such that the flanges of the brackets are fitted in the gaps defined between the ribs and the lower surface of the lower frame.

6. The shelf as set forth in claim 5, wherein the brackets include front and rear connection members disposed at the front and rear parts of the brackets and extending between the brackets to connect the brackets, and wherein each of the ribs has at least one stopper formed by cutting the rib and then bending downward, the stoppers being contact with the bent rear surface of anyone of the connection members to allow that the shelf is prevented from being moved to the front of the refrigerator.

7. The shelf as set forth in claim 5, wherein the brackets include front and rear connection members disposed at the front and rear parts of the brackets and extending between the brackets to connect the brackets, and wherein each of the ribs has front and rear stoppers formed by cutting the rib and then bending downward, the front stopper being pressed by the front connection member to allow that the shelf is pulled to the front of the refrigerator and the rear stopper being caught by the rear connection members to allow that the shelf is prevented from being further pulled forward.

8. The shelf as set forth in claim 7, wherein the lower frame is provided with grooves at the lower surface thereof, by which the shelf can be smoothly slid from the flanges of the brackets.

9. The shelf as set forth in claim 5, wherein the first engaging means includes:

latch parts formed at both sides of the lower surface of the upper frame, the latch parts extending downward and being bent outward; and flanges formed at both sides of the upper surface of the lower frame, the flanges extending upward and being then bent inward such that the flanges of the low frame are engaged with the latch parts of the upper frame.

10. The shelf as set forth in claim 5, wherein the second engaging means includes:

at least one first hole formed at the front end of the upper frame;

at least one first protrusion formed at the front end of the lower frame such that the first protrusion is fitted in the first hole;

at least one second protrusion formed at the rear end of the upper frame; and at least one second hole formed at the rear end of the lower frame such that the second protrusion is fitted in the second hole.

11. The shelf as set forth in claim 5, wherein the sealing means includes:

a plurality of grooves formed along the circumference of the upper frame; and silicon rubber filled in the grooves.

* * * * *